US010406830B2

(12) United States Patent
Condello et al.

(10) Patent No.: US 10,406,830 B2
(45) Date of Patent: Sep. 10, 2019

(54) DECAL PRINT PROCESS

(71) Applicant: Xerox Corporation, Norwalk, CT (US)

(72) Inventors: Anthony S. Condello, Webster, NY (US); Jack T. Lestrange, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/472,727

(22) Filed: Mar. 29, 2017

(65) Prior Publication Data

US 2018/0281467 A1 Oct. 4, 2018

(51) Int. Cl.

| | |
|---|---|
| ***B41J 2/01*** | (2006.01) |
| ***B41J 11/00*** | (2006.01) |
| ***B41J 3/407*** | (2006.01) |

(52) U.S. Cl.

CPC ..... *B41J 11/002* (2013.01); *B41J 3/407* (2013.01); *B41J 3/4078* (2013.01); *B41J 2002/012* (2013.01)

(58) Field of Classification Search

None

See application file for complete search history.

(56) References Cited

U.S. PATENT DOCUMENTS

| | | | | |
|---|---|---|---|---|
| 3,132,962 | A * | 5/1964 | Seymour | G03G 15/321 118/44 |
| 4,177,309 | A | 12/1979 | Shadbolt et al. | |
| 4,308,310 | A | 12/1981 | Arnold et al. | |
| 4,421,816 | A | 12/1983 | Arnold | |
| 4,517,044 | A | 5/1985 | Arnold | |
| 4,529,654 | A | 7/1985 | Drum | |
| 4,863,536 | A * | 9/1989 | Heidenhain | B29C 35/08 156/56 |
| 5,032,449 | A | 7/1991 | af Strom | |
| 5,322,708 | A | 6/1994 | Eissele | |
| 5,824,395 | A | 10/1998 | Zemel | |
| 6,174,607 | B1 | 1/2001 | Sugita et al. | |
| 6,358,660 | B1 | 3/2002 | Agler et al. | |
| 6,506,445 | B2 | 1/2003 | Popat et al. | |
| 6,869,910 | B2 | 3/2005 | Williams et al. | |
| 7,014,895 | B1 | 3/2006 | Grotefend et al. | |

(Continued)

FOREIGN PATENT DOCUMENTS

| | | |
|---|---|---|
| EP | 0380356 A3 | 8/1990 |

*Primary Examiner* — Matthew Luu
*Assistant Examiner* — Tracey M McMillion
(74) *Attorney, Agent, or Firm* — Gibb & Riley, LLC

(57) ABSTRACT

Backing material is passed by a first heater to pre-heat the backing material. The backing material is then passed by a printing engine to print marking material on the backing material, and passed by a first light source to apply ultra-violet (UV) light to the marking material printed on the backing material, to partially cure the marking material. Further, the backing material is passed by a container to expose the partially cured marking material to adhesive particles to cause the adhesive particles to adhere only to the marking material. The backing material is passed by a second light source to apply additional UV light to the marking material partially cured on the backing material to fully cure the marking material. Finally, the backing material is passed by a second heater to melt the adhesive particles that are adhered to the marking material on the backing material.

20 Claims, 5 Drawing Sheets

(56) References Cited

U.S. PATENT DOCUMENTS

| | | | | |
|---|---|---|---|---|
| 9,346,303 | B2 * | 5/2016 | Grinberg | B41M 3/006 |
| 2003/0184644 | A1 * | 10/2003 | Takahashi | C09K 11/06<br>347/224 |
| 2011/0261102 | A1 * | 10/2011 | Kurasawa | B41J 11/002<br>347/16 |

* cited by examiner

DECAL PRINT PROCESS

BACKGROUND

Systems and methods herein generally relate to systems for decal printing on backing material.

The printing of decals and the process of heat transferring (iron-on) to a media, such as a T-shirt is very useful. Using customized digitally created decals usually involves first forming a heat sensitive glue background (that is white) on backing material. The artwork and other materials are printed on top of the white heat-sensitive glue background. During transfer from the backing material to the T-shirt, the decal is heated to activate the glue, causing the printed matter to bond to the T-shirt.

However, if the printing does not fully cover the adhesive, it can leave an unattractive appearance on the media (T-shirt). Additionally, it can be necessary to trim the portion of the adhesive background that extends beyond the printed image, to again avoid the unattractive appearance of the adhesive. Thus, the glue background sometimes appears as an unattractive outline, or requires precision trimming prior to transfer.

SUMMARY

Exemplary apparatuses herein include (among other components), a transport device capable of moving backing material. Therefore, the transport device moves the backing material by a first heater that is positioned to pre-heat backing material. Further, a printing engine is positioned to receive the backing material from the first heater (as the backing material is moved by the transport device) and print marking material on the backing material, after the backing material has been pre-heated by the first heater. The printing engine prints on backing material that lacks an adhesive background, as the adhesive is applied later than it is done conventionally.

Additionally, a first light source is positioned to receive the backing material from the printing engine (as the backing material is moved by the transport device) and apply ultra-violet (UV) light to the marking material printed on the backing material, to partially cure the marking material.

A container is positioned to receive the backing material from the first light source (as the backing material is moved by the transport device) and expose the marking material that is partially cured on the backing material to potentially airborne adhesive particles, to cause the adhesive particles to adhere to the marking material partially cured on the backing material. More specifically, the container has an enclosed interior with openings that are positioned to allow the marking material to enter and exit the enclosed interior. Thus, movement of the backing material through the container forms a mono-layer of the adhesive particles on the marking material. The container can also include a removal structure that is positioned to remove excessive adhesive particles from the marking material partially cured on the backing material, as the backing material exits the container.

Also, a second light source is positioned to receive the backing material from the container (as the backing material is moved by the transport device) and apply additional UV light to the marking material partially cured on the backing material to fully cure the marking material. Further, a second heater is positioned to receive the backing material from the second light source (as the backing material is moved by the transport device) to melt the adhesive particles that are adhered to the marking material on the backing material. In addition, a cooler can be positioned to receive the backing material from the second heater (as the backing material is moved by the transport device) so as to remove heat from the marking material.

Thus, as shown above, the transport device is capable of moving the backing material by the first heater, the printing engine, the first light source, the container, the second light source, the second heater, the cooler, etc. In this processing, the backing material is moved from the printing engine to the first light source within a first time limit, moved from the first light source to the container within a second time limit, and moved from the container to the second light source within a third time limit.

Various methods herein pass backing material by a first heater to pre-heat the backing material, pass the backing material by a printing engine (after the backing material has been pre-heated by the first heater) to print marking material on the backing material, and pass the backing material by a first light source to apply UV light to the marking material printed on the backing material to partially cure the marking material.

Further, these methods pass the backing material by a container to expose the marking material partially cured on the backing material to adhesive particles to cause the adhesive particles to adhere to the marking material partially cured on the backing material. Again, the container can include an enclosed interior having openings that are positioned to allow the backing material to enter and exit the enclosed interior, such that the passing process moves the backing material through the container and forms a mono-layer of the adhesive particles on the marking material. These methods can also remove excessive adhesive particles from the marking material partially cured on the backing material as the backing material exits the container using a removal structure of the container.

Such methods pass the backing material by a second light source to apply additional UV light to the marking material partially cured on the backing material to fully cure the marking material. Finally, the backing material is passed by a second heater to melt the adhesive particles that are adhered to the marking material on the backing material, and passed by a cooler to remove heat from the backing material, cured marking material, and melted adhesive.

In these methods, the backing material is moved from the printing engine to the first light source within a first time limit, moved from the first light source to the container within a second time limit, and moved from the container to the second light source within a third time limit.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, the white heat-sensitive glue background used in decals manufacturing either appears as an unattractive outline or requires precision trimming prior to transfer. In view of this, the devices and methods disclosed herein provide the ability to create fully customizable transfer decals, with high durability, high resolution, and without undesired edge trimming (at potentially high speeds).

The devices and methods described herein produce unique qualities including printing at very high resolution (at least 600×600 dpi) without the need for white or clear background outlines, digital imaging that requires no pre- or post-production custom trimming/cutting, the ability to easily run high volumes of fully customizable images, etc.

Therefore, rather than forming a heat sensitive glue background (that is white) on the backing material before printing the decal design, instead these methods and devices first print on the backing material, and then form a mono-layer of adhesive particles on the marking material, which thereby avoids having the adhesive be present in locations other than where the ink is located, and therefore this eliminates the need for trimming, etc.

Figure 1:
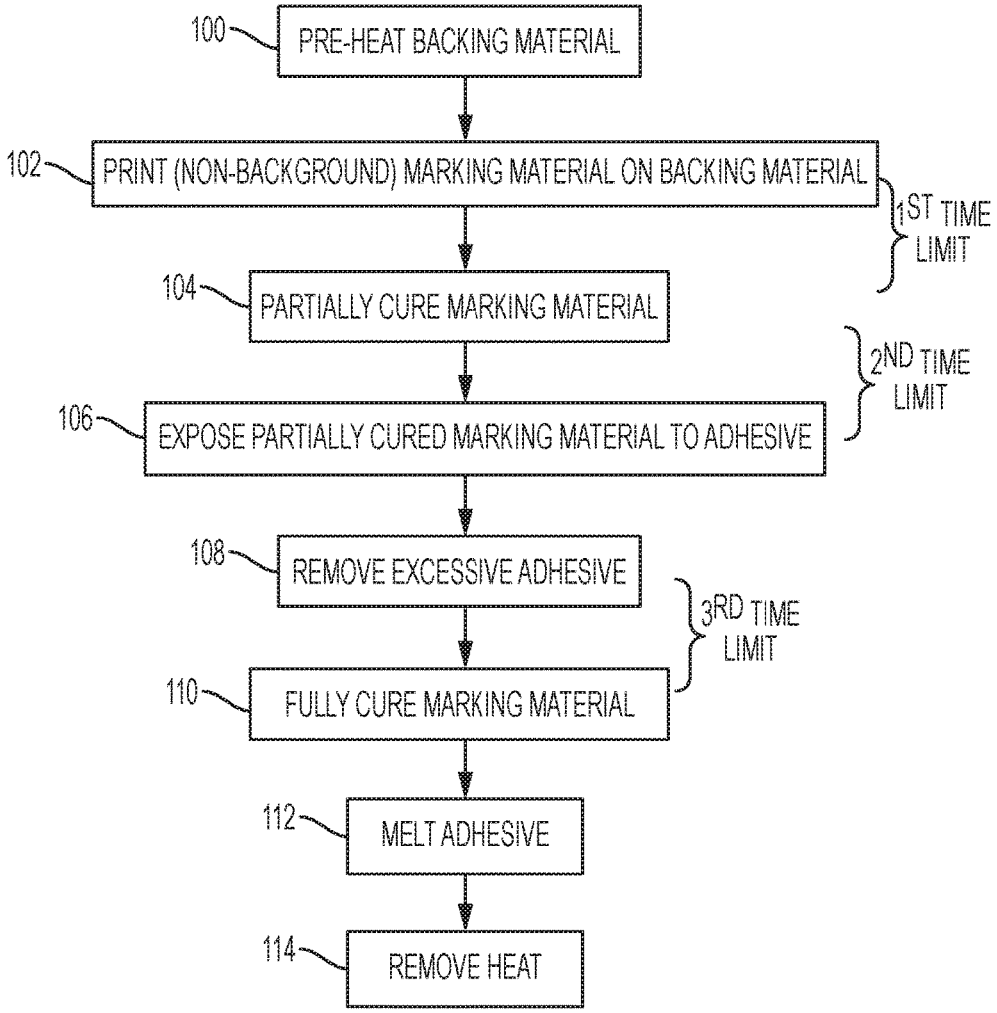
FIG. 1 is a flow diagram of various methods herein.

FIG. 1 is flowchart illustrating exemplary methods herein. In item 100, these methods pass backing material (that lacks any adhesive) by a first heater to pre-heat the backing material. The backing material can be any appropriate material such as natural or synthetic coated paper, plastic, vinyl polyester, etc., and can be in cut sheets or web form (continuous roll form). For example, in item 100 the backing material can be pretreated with a flame, light, resistive heater, plasma, corona, etc., to ensure good ink wetting.

In item 102, these methods pass the backing material by a printing engine (after the backing material has been pre-heated by the first heater) to print marking material (using UV curable ink) in the decal pattern and color on the backing material. For example, a somewhat flexible "stretchy" when cured UV ink can be used to avoid cracking in the final image. Once printed, the UV ink will start to spread out on, and seep into, the backing material, both of which can have a temporal aspect. Therefore, to avoid undesirable excessive ink spread and seek, the process is managed by proceeding to step 104 within a fixed time (e.g., first time limit).

In item 104, such methods pass the backing material by a curing station (first light source) to apply UV light to the marking material printed on the backing material to only partially cure the marking material (e.g., using UV lamp (LED and/or D-Bulb). This partial curing 104 only supplies enough UV exposure to immobilize the ink from further spreading. However, this partial curing 104 does not fully cure the image, and leaves the ink uncured an amount to keep the ink in a tacky state (to allow adhesive (glue) applied in item 106 to adhere to the ink).

More specifically, in item 106, these methods pass the backing material by a container to expose the partially cured marking material on the backing material to adhesive particles to cause the adhesive particles to adhere only to the marking material partially cured on the backing material (and not to the backing material itself). Therefore, in item 106, once the ink is in a tacky state, it can travel to a glue "particle-cloud."

Therefore, the initial curing in item 104 is limited, to allow the subsequently applied glue in item 106 to stick only onto the outer ink surface. The total energy and peak power values using during the partial curing 104 are ink dependent. Again, supplying the partially cured ink to the adhesive application in item 106 is time dependent, and is therefore also controlled to occur within a time limit (e.g., a second time limit, which may be the same or different from the first time limit).

The container used in item 106 can include an enclosed interior having openings that are positioned to allow the backing material to enter and exit the enclosed interior, such that the processing in item 106 moves the backing material through the container that contains the adhesive particles in airborne form, and forms only a mono-layer of the adhesive particles only on the marking material. This is just one of many ways that the glue may be applied and, for example, alternatively a cascading method can be used to apply the adhesive particles.

During the processing in item 106, the particles of adhesive only stick to the partially cured image in a mono-layer because the adhesive itself is not be sticky at this point (preventing a thick layer of adhesive forming); but the partially cured marking material is still tacky. Therefore, the adhesive particles only stick to the tacky partially cured marking material (and not to other adhesive particles), forming only a mono-layer of particles on the partially cured marking material that is present on the backing material.

Excess glue can optionally be removed via mechanical vibrations and/or moderate air flow, and this is shown in item 108, where these methods remove excessive adhesive particles from the marking material partially cured on the backing material as the backing material exits the container (e.g., using a removal structure of the container, such as an air knife that keeps the adhesive particles in the container while knocking excess glue from the image and media).

Such methods pass the backing material by a final curing station (second light source) in item 110 to apply additional UV light to the marking material that is partially cured on the backing material, to fully cure the marking material. The ink at this juncture is still in a partially cured state, so the processing in item 110 solidifies the image to its final stretchy, yet highly durable, fully cured state, and such processing minimizes any further ink migration. As with previous processing, moving between steps 106 and 110 is time sensitive (because the ink is not yet fully cured), so such processing also occurs within a time limit (e.g., third time limit, which again can be the same or different from the previously discussed time limits).

In other words, the partial curing 104 only uses sufficient power/time during UV light exposure to cause initial bonds of the UV curable marking material to form (mostly interior bonds), to just keep the marking material from running, and make the marking material tacky. To the contrary, the final curing 112 uses more power/time to cause all bonds on the exterior and interior of the UV curable marking material to completely form, to fully cure the marking material.

The mono-layer of glue particles are now adhered enough to the inked image to not fall off under their own weight, but the particles can still be easily rubbed away with any type of contacting force. Therefore, in item 112, to fuse the adhesive particles together and prepare the adhesive covered marking material to not be disturbed by subsequently applied rollers or other structures used for handling the finished decal, these methods pass the backing material by a second heater to only initially melt the adhesive particles that are adhered to the marking material on the backing material.

However, the second heating process in item 112 is controlled by limited time and/or temperature to avoid fully melting and activating the adhesive particles. Thus, instead of the prolonged exposure to high heat that occurs when the finished decal is transferred from the backing material to the final media (e.g., heat transferred to a T-shirt), the heat and time is limited in item 112 to that which minimally bonds the adhesive particles together, and to the fully cured marking material. Thus, the second heating process 112 heats the adhesive particles below a temperature that would cause the adhesive particles to become viscous, and instead only heats the adhesive particles sufficiently to cause initial melting or softening of the adhesive particles, without full melting. The temperature at which this occurs varies depending upon the adhesive material used.

The decal may be at too high of a temperature for rolling, stacking, or touching at this point in the processing. Therefore, in item 114, the decal is cooled via contact or non-contact devices, and this process allows the adhesive to return to a fully solid state (and not be tacky or sticky). For example, in item 114, the backing material can be passed by a cooler to remove heat from the backing material, cured marking material, and melted adhesive.

Therefore, as shown in FIG. 1, the backing material is moved from the printing engine to the first light source within a first time limit, moved from the first light source to the container within a second time limit, and moved from the container to the second light source within a third time limit.

Figure 2:
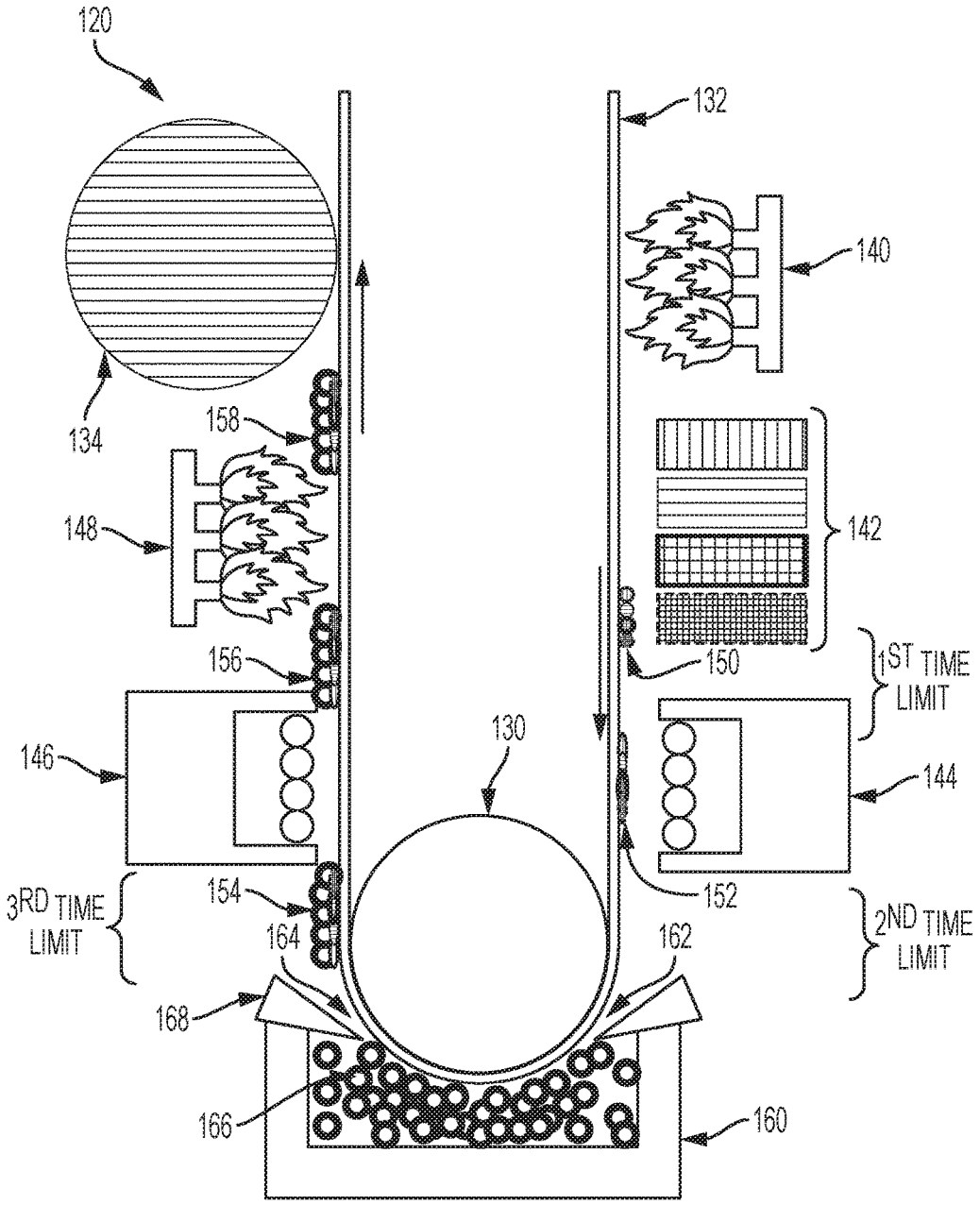
FIGS. 2-4 are schematic diagrams illustrating systems herein.

FIG. 2 similarly shows exemplary apparatuses (e.g., decal production system 120) herein that include (among other components), a transport device 130 capable of moving backing material 132. Therefore, the transport device 130 moves the backing material 132 by a first heater 140 that is positioned to pre-heat backing material 132.

Further, a printing engine 142 is positioned to receive the backing material 132 from the first heater 140 (as the backing material 132 is moved by the transport device 130) and print marking material 150 on the backing material 132, after the backing material 132 has been pre-heated by the first heater 140. The printing engine 142 prints on backing material 132 that lacks an adhesive background, as the adhesive 166 is applied later than it is done conventionally.

Additionally, a first light source 144 is positioned to receive the backing material 132 from the printing engine 142 (as the backing material 132 is moved by the transport device 130) and apply ultra-violet (UV) light to the marking material 150 printed on the backing material 132, to partially cure the marking material (shown by item 152).

A container 160 is positioned to receive the backing material 132 from the first light source 144 (as the backing material 132 is moved by the transport device 130) and expose the marking material 152 that is partially cured on the backing material 132 to (potentially airborne) adhesive particles 166, to cause the adhesive particles 166 to adhere to only the sticky marking material 150 partially cured on the backing material 132 (shown by item 154). The backing material 132 may be exposed to airborne adhesive particles 166, or may be passed through a bulk supply of the adhesive particles 166 within the container 160 (so long as doing so does not disturb the marking material 152, which may require a higher level of partial curing).

More specifically, the container 160 has an enclosed interior containing airborne adhesive particles, with openings 162, 164 that are positioned to allow the backing material 132 to enter and exit the enclosed interior. Thus, movement of the backing material 132 through the container 160 forms a mono-layer of the adhesive particles 166 on the partially cured marking material 152 (shown by item 154). The container 160 can also include a removal structure 168 (e.g., an air knife, a linear edge, brushes, etc.) that is positioned to remove excessive adhesive particles 166 from the marking material 154 partially cured on the backing material 132, as the backing material 132 exits the container 160.

Also, a second light source 146 is positioned to receive the backing material 132 from the container 160 (as the backing material 132 is moved by the transport device 130) and apply additional UV light to the marking material 154 partially cured on the backing material 132 to fully cure the marking material (as shown by item 156). Further, a second heater 148 is positioned to receive the backing material 132 from the second light source 146 (as the backing material 132 is moved by the transport device 130) to partially melt the adhesive particles 166 that are adhered to the fully cured marking material 156 on the backing material 132, to allow the adhesive material to join with the fully cured marking material 156 (as shown by item 158). In addition, a cooler 134 can be positioned to receive the backing material 132 from the second heater 148 (as the backing material 132 is moved by the transport device 130) so as to remove heat from the marking material 158.

Thus, as shown above, the transport device 130 is capable of moving the backing material 132 by the first heater 140, the printing engine 142, the first light source 144, the container 160, the second light source 146, the second heater 148, the cooler 134, etc. As shown in FIG. 2, the backing material 132 is moved from the printing engine 142 to the first light source 144 within a first time limit, moved from the first light source 144 to the container 160 within a second time limit, and moved from the container 160 to the second light source 146 within a third time limit.

Figure 3:
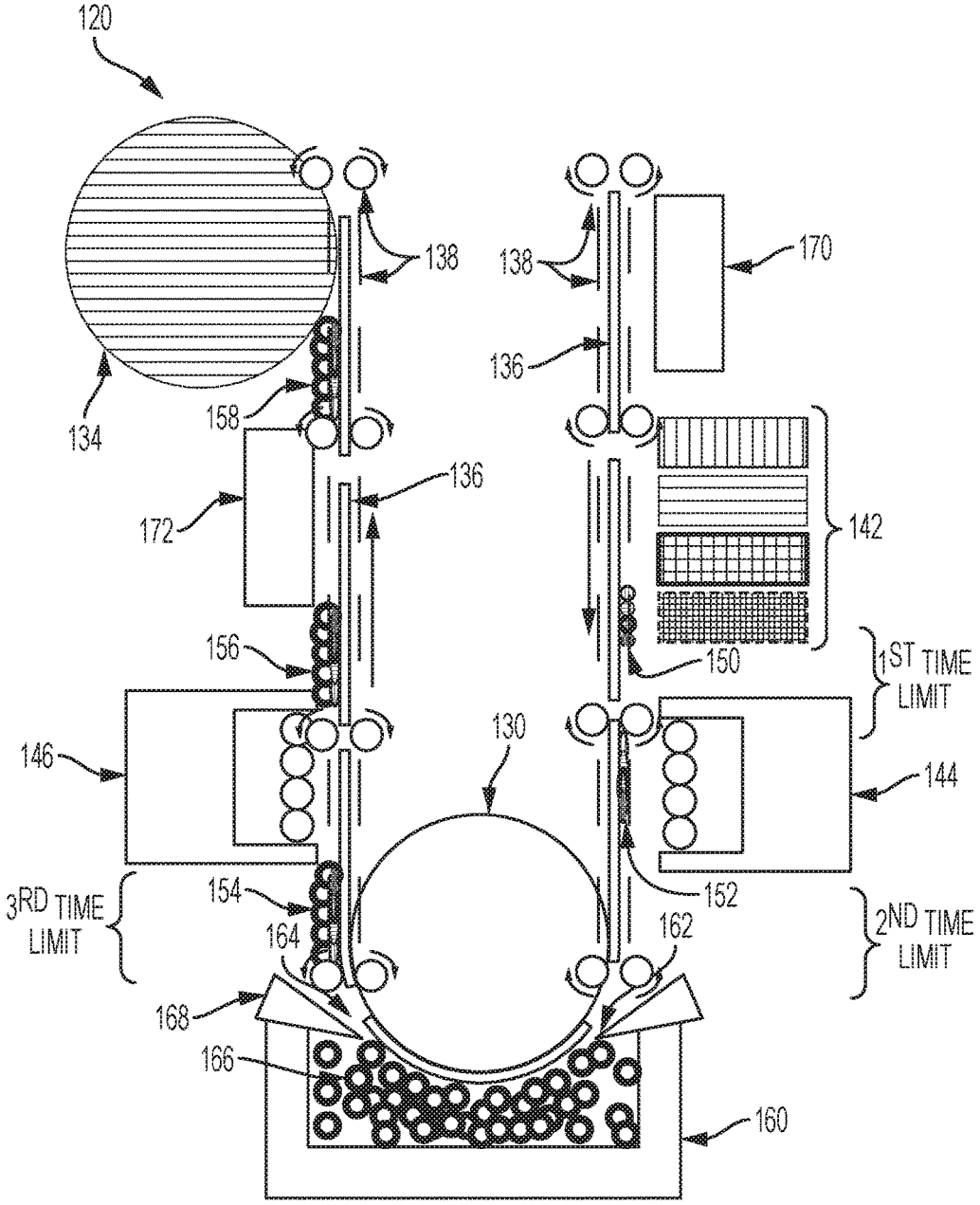

Note that while the backing material 132 is shown as a web of material in FIG. 2, FIG. 3 shows a similar structure that is utilized for cut sheets of backing material 136. Therefore, the structure shown in FIG. 3 includes rollers and guides 138 that move the cut sheets of backing material 136 along the path described above. Additionally, FIG. 3 illustrates alternative heating devices 170, 172 in place of the open flame first and second heaters 140, 148 that can include corona heaters, infrared heaters, resistive heaters, etc.

Figure 4:
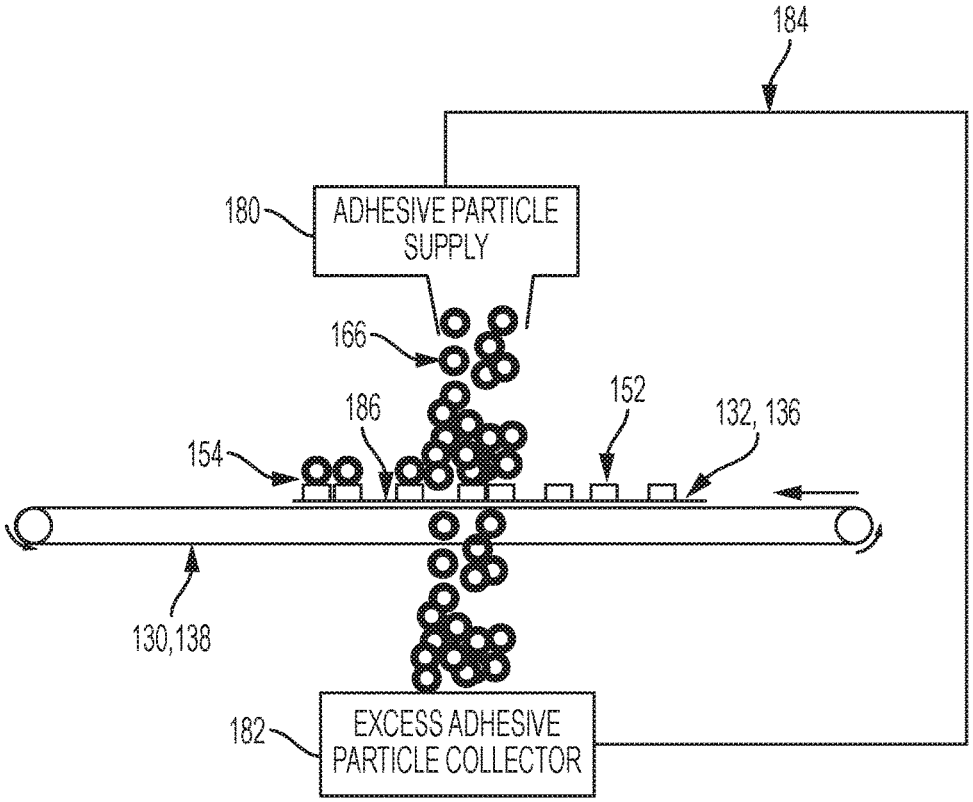

FIG. 4 illustrates an alternative to the airborne adhesive particle container 160 shown in FIGS. 2 and 3. More specifically, FIG. 4 illustrates any form of an adhesive particle supply 180 that supplies the adhesive particles 166 to the partially cured, tacky marking material 152 that has been printed and partially cured on the backing material 132, 136. This alternative also includes an excess adhesive particle collector 182, and a return supply structure (belt, tube, transport, etc.) 184 that returns the excess adhesive particles from the collector 182 to the supply 180, to prevent waste.

In one example, the adhesive particle supply 180 can deposit (using gravity, a hopper, a feed belt, etc.) the adhesive particles 166 (for example, in a cascade manner) directly on to the tacky marking material 152 as the backing material 132, 136 passes beneath the adhesive particle supply 180 (when, for example, the rollers and guides 130, 138 move the backing material 132, 136). At this point in the process, the adhesive particles 166 have not been heated and are, therefore, not sticky. Because of this, any excess adhesive particles 166 that do not stick to the tacky marking material 152 fall into the collector 182.

FIG. 4 also illustrates that the adhesive particles 166 only stick to the partially cured tacky marking material 152 (converting such into item 154, as discussed above) and the adhesive particles 166 do not adhere to the rollers and guides 138, or to the other portions of the backing material 132, 136. Therefore, for example, identification 186 illustrates an area of the backing material 132, 136 where there is no printing; and, as can be seen in FIG. 4, no adhesive particles 166 attach to the portions of the backing material 132, 136 where there is no printing (186).

In this way, the adhesive particles 166 are only positioned in locations where the marking material 150 is printed. This prevents the adhesive material 166 from accumulating in any other areas, eliminating the need for trimming. This also prevents the adhesive material 166 from appearing on the final media (e.g., T-shirt) to which it will eventually be transferred. This shows that the devices and methods herein avoid having to trim excess adhesive from the perimeter of the design, and they also prevent adhesive from appearing in any non-printed areas 186 inside the perimeter of the design. This not only makes the decal creation process more efficient, it also reduces the amount of adhesive utilized, making the entire system more material usage efficient. Additionally, by reducing the amount of adhesive that is utilized for the decal, the chance of excess adhesive marring the final product to which of the decal is transferred is reduced.

In other words rather than forming a heat sensitive glue background (that is white) on the backing material before printing, instead these methods and devices first print marking material on the backing material 132, 136 that lacks any adhesive, and then form a mono-layer of adhesive particles 166 only on the tacky marking material 154. The subsequent heating of the adhesive particles 166 heats the adhesive particles 166 below a temperature that would cause the adhesive particles 166 to become fully viscous, and run freely. Instead, the second heater 148, 172 is controlled to only heat the adhesive particles 166 sufficiently to cause initial melting or softening of the adhesive particles 166, without full melting. This leaves the adhesive particles 166 is place and connected to the marking material 154 on the backing material 132, 136.

Subsequent processing that transfers the decal to a different material uses relatively more heat (e.g., higher heat, longer heat exposure, or both) than the second heating process 112. This later-applied higher heat used in the process that transfers the decal from the backing material 132, 136 to another surface causes the adhesive material 166 to become fully viscous to allow the adhesive material 166 to permanently bond the marking material 154 to the external media (T-shirt). As noted above, the function of the second heater 148, 172 is only to prevent the adhesive particles 166 from being inadvertently dislodged from the marking material 154 during subsequent processing, but limits the heat applied so that the adhesive particles 166 are not separated from the marking material 154.

With the systems described above, 142 the printing engine prints on backing material 132, 136 that lacks any adhesive background, because with devices herein the adhesive particles 166 are applied later than it is done conventionally. This overcomes conventional problems of the unattractive appearance of the adhesive background (that may remain after printing), and of issues related to trimming the portion of the adhesive background that extend beyond the printed image.

Figure 5:
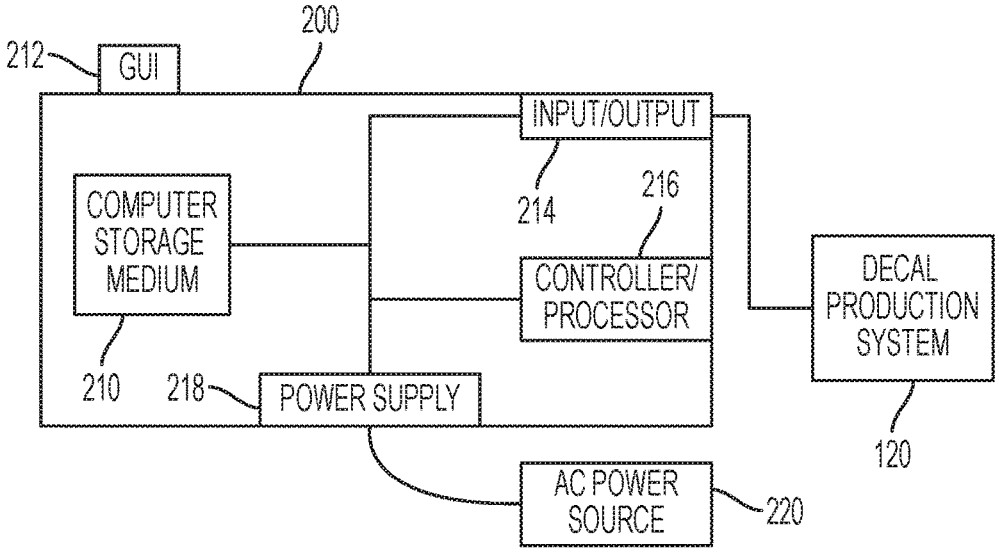
FIGS. 5-6 are schematic diagrams illustrating devices herein.

FIG. 5 illustrates a computerized device 200 electrically connected to the above-described decal production system(s) 120, which can be used with systems and methods herein to control the speed of the backing material, to control the printing engine, to control the curing stations, to control the heaters, to control the cooler, etc.; and can comprise, for example, a server, a personal computer, a portable computing device, etc. The computerized device 200 includes a controller/tangible processor 216 and a communications port (input/output) 214 operatively connected to the tangible processor 216 and to the computerized network 202 external to the computerized device 200. Also, the computerized device 200 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the computerized device 200 and comprises a wired device or wireless device (of any form, whether currently known or developed in the future). The tangible processor 216 controls the various actions of the computerized device. A non-transitory, tangible, computer storage medium device 210 (which can be optical, magnetic, capacitor based, etc., and is different from a transitory signal) is readable by the tangible processor 216 and stores instructions that the tangible processor 216 executes to allow the computerized device to perform its various functions, such as those described herein. Thus, as shown in FIG. 5, a body housing has one or more functional components that operate on power supplied from an alternating current (AC) source 220 by the power supply 218. The power supply 218 can comprise a common power conversion unit, power storage element (e.g., a battery, etc), etc.

Figure 6:
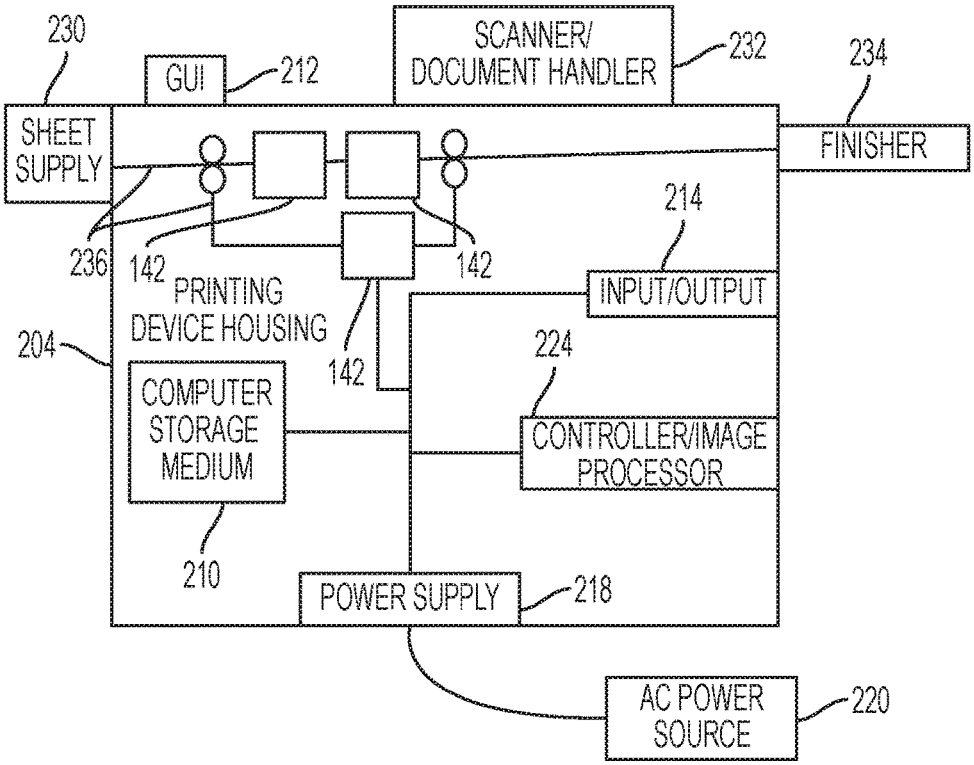

FIG. 6 illustrates a computerized device that is a printing device 204, which can be used with systems and methods herein and can comprise, for example, a printer, copier, multi-function machine, multi-function device (MFD), etc. The printing device 204 includes many of the components mentioned above and at least one marking device (printing engine(s)) 142 operatively connected to a specialized image processor 224 (that is different from a general purpose computer because it is specialized for processing image data), a media path 236 positioned to supply continuous media or sheets of media from a sheet supply 230 to the marking device(s) 142, etc. After receiving various markings from the printing engine(s) 142, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 142 are intended to illustrate any marking device that applies a marking material (toner, inks, etc.) to continuous media or sheets of media, whether currently known or developed in the future and can include, for example, devices that use a photoreceptor belt or an intermediate transfer belt, or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/ output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a first heater positioned to pre-heat backing material;

a printing engine positioned to receive said backing material from said first heater and print marking material on said backing material after said backing material has been pre-heated by said first heater, during said printing, said backing material lacks an adhesive background;

a first light source positioned to receive said backing material from said printing engine and apply ultraviolet (UV) light to said marking material printed on said backing material to partially cure said marking material;

a container positioned to receive said backing material from said first light source and expose said marking material partially cured on said backing material to airborne adhesive particles to cause said adhesive particles to adhere to said marking material partially cured on said backing material;

a second light source positioned to receive said backing material from said container and apply additional UV light to said marking material partially cured on said backing material to fully cure said marking material; and a second heater positioned to receive said backing material from said second light source and melt said adhesive particles that are adhered to said marking material on said backing material.

2. The apparatus according to claim 1, movement of said backing material through said container forms a mono-layer of said adhesive particles on said marking material.

3. The apparatus according to claim 1, said container comprises a removal structure positioned to remove excessive adhesive particles from said marking material partially cured on said backing material as said backing material exits said container.

4. The apparatus according to claim 1, said container comprises an enclosed interior having openings positioned to allow said marking material to enter and exit said enclosed interior.

5. The apparatus according to claim 1, said container comprises a removal structure positioned to remove excessive adhesive particles to leave said adhesive particles only on said marking material.

6. The apparatus according to claim 1, wherein total energy and power values of said first light source are set to form only interior bonds of said marking material and prevent said marking material from running, while keeping an outer surface of said marking material tacky.

7. The apparatus according to claim 1, said first light source is positioned to receive said backing material from said printing engine within a time limit after said printing engine has printed said marking material on said backing material that is less than an amount of time in which said marking material seeps into said backing material.

8. An apparatus comprising:

a printing engine positioned to print marking material in a pattern on backing material while said backing material lacks adhesive;

a first light source positioned to receive said backing material from said printing engine and apply light to said marking material printed on said backing material to partially cure said marking material;

a container positioned to receive said backing material from said first light source and expose said marking material partially cured on said backing material to adhesive particles to cause said adhesive particles to adhere to said marking material partially cured on said backing material;

a second light source positioned to receive said backing material from said container and apply additional light to said marking material partially cured on said backing material to fully cure said marking material; and a heater positioned to receive said backing material from said second light source and melt said adhesive particles that are adhered to said marking material.

9. The apparatus according to claim 8, movement of said backing material through said container forms a mono-layer of said adhesive particles on said marking material.

10. The apparatus according to claim 8, said container comprises a removal structure positioned to remove excessive adhesive particles from said marking material partially cured on said backing material as said backing material exits said container.

11. The apparatus according to claim 8, said container comprises a removal structure positioned to remove excessive adhesive particles to leave said adhesive particles only on said marking material.

12. The apparatus according to claim 8, said container comprises an enclosed interior having openings positioned to allow said marking material to enter and exit said enclosed interior.

13. The apparatus according to claim 8, wherein total energy and power values of said first light source are set to form only interior bonds of said marking material and prevent said marking material from running, while keeping an outer surface of said marking material tacky.

14. The apparatus according to claim 8, said first light source is positioned to receive said backing material from said printing engine within a time limit after said printing engine has printed said marking material on said backing material that is less than an amount of time in which said marking material seeps into said backing material.

15. An apparatus comprising:

a printing engine positioned to print marking material in a pattern on backing material while said backing material lacks adhesive;

a first light source positioned to receive said backing material from said printing engine and apply light to said marking material printed on said backing material to cure less than all bonds of said marking material;

a container positioned to receive said backing material from said first light source and expose said marking material on said backing material to adhesive particles to cause said adhesive particles to adhere to said marking material; and a second light source positioned to receive said backing material from said container and apply additional light to said marking material to fully cure all remaining bonds of said marking material.

16. The apparatus according to claim 15, movement of said backing material through said container forms a monolayer of said adhesive particles on said marking material.

17. The apparatus according to claim 15, said container comprises a removal structure positioned to remove excessive adhesive particles from said marking material partially cured on said backing material as said backing material exits said container.

18. The apparatus according to claim 15, said container comprises a removal structure positioned to remove excessive adhesive particles to leave said adhesive particles only on said marking material.

19. The apparatus according to claim 15, said container comprises an enclosed interior having openings positioned to allow said marking material to enter and exit said enclosed interior.

20. The apparatus according to claim 15, wherein total energy and power values of said first light source are set to form only interior bonds of said marking material and prevent said marking material from running, while keeping an outer surface of said marking material tacky.

* * * * *